United States Patent [19]

Morin

[11] 4,368,516

[45] Jan. 11, 1983

[54] EUCHRE SCORING COMPUTER AND METHOD

[76] Inventor: Roger W. Morin, 1426 Stag Dr., Fort Wayne, Ind. 46804

[21] Appl. No.: 199,076

[22] Filed: Oct. 20, 1980

[51] Int. Cl.[3] ..... G06F 15/44

[52] U.S. Cl. ..... 364/411; 235/926 A; 273/148 R; 340/323 R; 364/709

[58] Field of Search ..... 364/410, 411, 709, 710; 235/92 GA; 273/148 R, 237; 340/323 R

[56] References Cited

U.S. PATENT DOCUMENTS

| | | | |
|---|---|---|---|
| 2,296,508 | 9/1942 | Eckert | 340/323 |
| 2,455,422 | 12/1948 | Kucks | 340/323 |
| 4,097,855 | 6/1978 | Salvo | 235/92 GA |
| 4,119,838 | 10/1978 | Genuit | 235/92 GA |
| 4,245,216 | 1/1981 | Rintoul | 273/148 R |
| 4,286,323 | 8/1981 | Meday | 364/709 |

OTHER PUBLICATIONS

"Correct Progressive Euchre Score System" – Am. Sta. – Apr. 12, 1888.

*Primary Examiner*—Errol A. Krass
*Attorney, Agent, or Firm*—David A. Lundy

[57] ABSTRACT

A euchre scoring computer which computes and displays euchre scores and performs the method of the invention comprising the steps of inputting first and second unit point information to respective first and second totalizers, totalizing the first and second unit point information at the respective first and second totalizers, generating first and second game point information at respective first and second generators responsive to first and second totalizers, respectively, zeroing the first and second totalizers in response to the first and second generators, respectively, establishing first and second skunk point information at respective first and second establishers responsive to the first and second generators and the first and second totalizers, respectively, and displaying the first and second unit, game and skunk point information.

20 Claims, 3 Drawing Figures power supplies may be utilized to furnish current to the device. Current from whatever power supply is chosen may be conventionally controlled through a single pole single throw on/off switch 24 for input to the electronic portion of the euchre scoring computer 10.

Points information for each respective player is input to the electronic circuitry of euchre scoring computer 10 by actuation of points buttons 30A and 30B which comprise conventional single pole single throw spring return push button switches. Depressing points button 30A places input line 36A at a logic level zero potential. Low pass filter network 32A, comprising resistor 33A and capacitor 34A serves to negate any contact bounce of the points button 30A.

Input line 36A is applied to the B input terminal of four bit binary points counter 38A. When $Q_A$ line 40A is fed back to the A input of four bit binary points counter 38A and R(0)1 and R(0)2 inputs are low, each actuation of points button 30A causes four bit binary points counter 38A to count each actuation thereof. Upon starting each game or after the euchre scoring computer 10 has been reset, $Q_A$ line 40A, $Q_B$ line 41A, $Q_C$ line 42A and $Q_D$ line 43A are all at a logic level zero potential. Upon the first actuation of points button 30A, $Q_A$ line 40A goes to logic level one state with respect to circuit ground. The next actuation of points button 30A causes $Q_B$ line 41A to go to a logic level one state while $Q_A$ line 40A goes to a logic level zero. Each successive actuation of points button 30A causes four bit binary points counter 38A to count upwards until $Q_D$ line 43A and $Q_B$ line 41A are at a logic level one, which condition occurs after the tenth actuation of points button 30A. At this point, NAND gate 74A has a logic level zero at its output on tens line 76A. This logic level zero is applied to one input of NAND gate 78A causing a logic one level to appear at the output thereof. This logic level one is applied to the R(0)1 and R(0)2 inputs of four bit binary points counter 38A. Tens line 76A also causes a logic zero level to appear at the A input of four bit binary games counter 80A and clear points line 86A through diode 84A as shall be more fully described hereinafter.

Display of the count registered by four bit binary points counter 38A is decoded by BCD to decimal points decoder 44A. $Q_A$ line 40A, $Q_B$ line 41A, $Q_C$ line 42A and $Q_D$ line 43A are connected respectively to the A, B, C and D inputs of BCD to decimal points decoder 44A. When all four inputs to BCD to decimal points decoder 44A are at a logic zero, a logic one indication appears at all of the outputs thereof with the exception of output lines 50A. This logic zero level on line 50A causes a voltage drop from $V_{CC}$ line 72 through resistor 70A causing the illumination of light emitting diode 60A. When a logic one input appears on $Q_A$ line 40A to the A input of BCD to decimal points decoder 44A, output line 50A goes to a logic one level and output line 51A goes to a logic zero level causing the illumination of light emitting diode 61A. This process continues in succession such that a logic zero level appearing on output line 52A causes the illumination of light emitting diode 62A; a logic zero level on output line 53A causes the illumination of light emitting diode 63A; a logic zero level on output line 54A causes the illumination of light emitting diode 64A; a logic zero level on output line 55A causes the illumination of light emitting diode 65A; a logic zero level on output line 56A causes the illumination of light emitting diode 66A; a logic zero level on output line 57A causes the illumination of light emitting diode 67A; a logic zero level on output line 58A causes the illumination of light emitting diode 68A; and a logic zero level on output line 59A causes the illumination of light emitting diode 69A. At this point, the next actuation of points button 30A causes four bit binary points counter 38A to be reset through NAND gates 74A and 78A such that logic zero levels again appear at the A, B, C and D inputs to BCD to decimal points decoder 44A. With these inputs, a logic zero level appears only on output line 50A thereby illuminating light emitting diode 60A.

Inverter 88A reverses this logic zero condition to a logic one condition which is thereafter applied on skunk line 89A to NAND gate 90B. In this manner, information relative to a points count greater than zero is input into the four bit binary games counter 80B of the opposing counter. A logic zero level appearing on skunk line 89A electrically obviates the generation of any skunk points for the opposing player should a logic zero level appear on tens line 76B.

Game point information is calculated by means of four bit binary games counter 80A. A logic zero level on tens line 76A is applied to the A input of four bit binary games counter 80A. This causes a logic one level to appear on output line 93A so long as the R(0)1 and R(0)2 inputs of four bit binary games counter 80A are other than both a logic one level. Output line 93A is applied to an input of BCD to decimal games decoder 98A. In addition to output line 93A, output lines 94A and 95A are applied respectively to the B and C inputs of BCD to decimal games decoder 98A. The D input to BCD to decimal games decoder 98A is held at a logic zero level by the grounding of ground line 96A. A logic one level appearing on output line 93A causes a logic zero level to appear at resistor 116A thereby causing the illumination of light emitting diode 111A connected to $V_{CC}$ line 72. Similarly, the varying logic levels appearing on output lines 93A, 94A and 95A are decoded through BCD to decimal games decoder 98A such that a logic zero level appearing at resistor 117A causes the illumination of light emitting diode 112A; a logic zero level appearing at resistor 118A causes the illumination of light emitting diode 113A; a logic zero level appearing at resistor 119A causes the illumination of light emitting diode 114A; and a logic zero level appearing at resistor 120A causes the illumination of light emitting diode 115A.

A logic zero level appearing on tens line 76A is also applied to inverter 82A such that a logic one level appears on line 91A. Line 91A is applied to one input of NAND gate 90A which has its output connected to the B input of four bit binary games counter 80A. The remaining input to NAND gate 90A appears on skunk line 89B at the output of inverter 88B. In this manner, information relative to the existence of a score greater than zero of the opposing player is applied to the input of four bit binary games counter 80A. Should a logic zero level appear on tens line 76A and a logic one level appear on skunk line 89B, a logic zero level is applied to the B input of four bit binary games counter 80A. This causes a logic one level to appear on output line 92A. A logic one level on output line 92A is applied to the input of inverter 102A and the active low clock input of dual flip-flop 100. Inverter 102A then causes a logic zero level to appear at resistor 103A thereby causing the illumination of light emitting diode 104A connected to $V_{CC}$ line 72. A subsequent indication of a logic zero level on tens line 76A coupled with a logic one level on

EUCHRE SCORING COMPUTER AND METHOD

BACKGROUND OF THE INVENTION

The invention relates to euchre scoring computers and methods and more particularly for an electronic computer and method for manual input of player point information for computation and display of point, game and skunk information in conjunction with a euchre card game.

The euchre group of card games is one of the largest and has a great number of enjoyable variations. Of the many scoring systems necessitated by these variations, all have traditionally been tabulated by means of manual transcription on paper. The necessity of manually keeping track of various player unit points is therefore tedious and awkward. Moreover, the computation of totals to compute game points and the concomitant award of skunk points to a player winning a game while his opponent as scored no unit points, can be distracting if not confusing.

It would therefore be highly desirable to provide a euchre scoring computer and method requiring only push button operation.

It would therefore also be highly desirable to provide a euchre scoring computer and method which automatically awards a game to the first player achieving a given number of unit points.

It would therefore also be highly desirable to provide a euchre scoring computer and method which automatically clears all unit point indicators after any player receives said given number of unit points.

It would therefore also be highly desirable to provide a euchre scoring computer and method which automatically awards a player who obtains said given number of unit points to his opponents zero number of unit points a skunk point.

SUMMARY OF THE INVENTION

Broadly the present invention is a euchre scoring computer comprising first and second means for inputting unit point information, first and second means for totalling the unit point information from the first and second inputting means respectively, first and second means responsive to the first and second totalling means respectively for generating game point information and zeroing the second and first totalling means respectively, first and second means responsive to the first and second generating means and the second and first totalling means respectively for establishing skunk point information, first and second means for displaying the unit, game and skunk point information, first and second means for resetting the first and second totalling means respectively, and means for clearing the first and second totalling, generating and establishing means. Also provided is a method for computing and displaying euchre scores comprising the steps of inputting first and second unit point information to respective first and second totallizers, totalling the first and second unit point information at the respective first and second totallizers, generating first and second game point information at respective first and second generators responsive to the first and second totallizers respectively, zeroing the second and first totallizers in response to the first and second generators, establishing first and second skunk point information at respective first and second establishers responsive to the first and second generators and the second and first totallizers respectively, displaying the first and second unit, game and skunk point information, resetting the first and second totallizers, and clearing the first and second totallizers, generators and establishers.

It is therefore an object of the invention to provide an improved euchre scoring computer and method which requires only push button operation.

It is another object of the invention to provide an improved euchre scoring computer and method which automatically awards a game to the first player achieving a given number of unit points.

It is another object of the invention to provide an improved euchre scoring computer and method which automatically clears all unit point indicators after any player receives said given number of unit points.

It is still further an object of the invention to provide an improved euchre scoring computer and method which automatically awards the player who obtains said given number of unit points to his opponents zero number of unit points, a skunk point.

BRIEF DESCRIPTION OF THE DRAWINGS

The above-mentioned and other features and objects of this invention and the manner of attaining them will become more apparent and the invention itself will be best understood by reference to the following description of an embodiment of the invention taken in conjunction with the accompanying drawings, wherein.

DESCRIPTION OF A SPECIFIC EMBODIMENT

Figure 1:
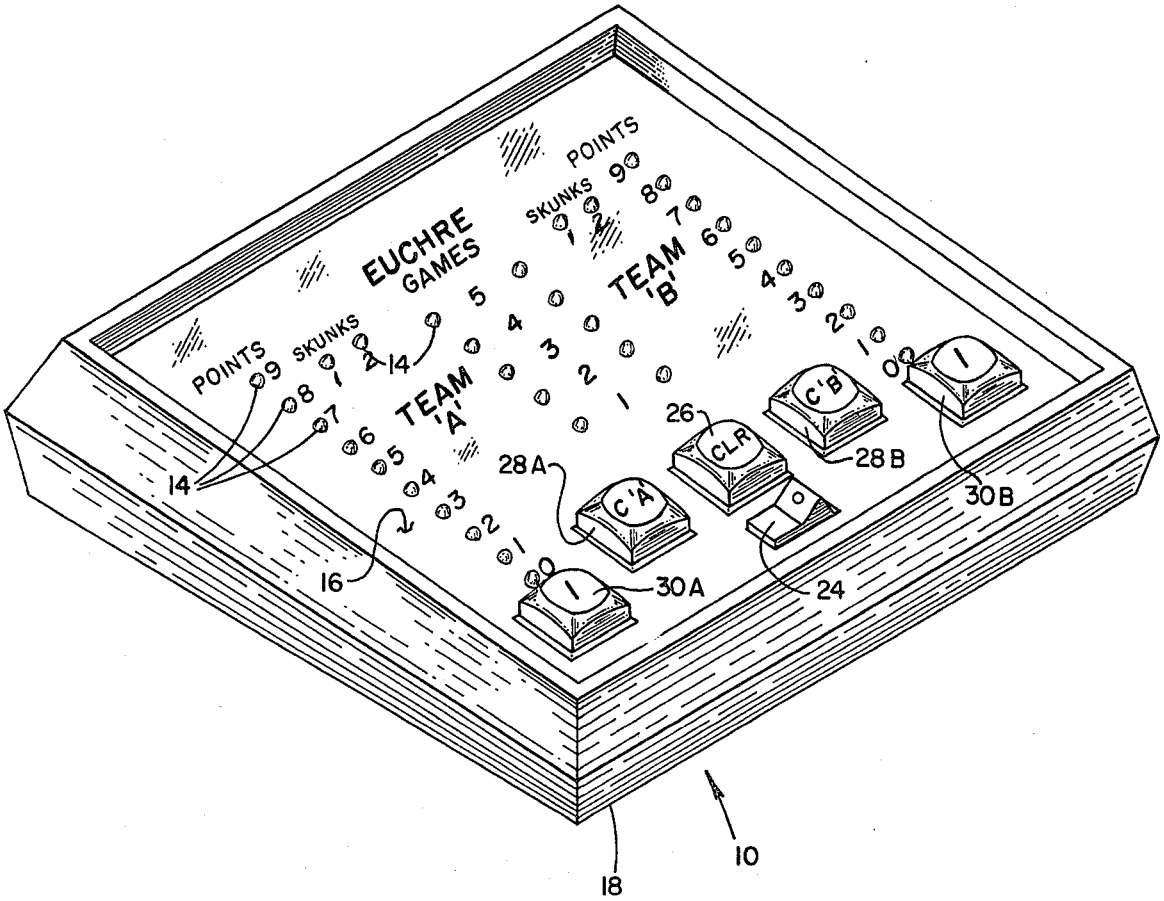
FIG. 1 is a perspective view of the display panel and case of the invention showing the push buttons, on/off switch, indicator lamps and scoring values.

Referring now to FIG. 1 the euchre scoring computer 10 of the invention is shown. Euchre scoring computer 10 comprises a display panel 16 mounted to case 18. A plurality of push buttons comprising clear/reset button 26, clear buttons 28A and 28B and points buttons 30A and 30B allow the clearing of previous inputs as well as the input of new information to the euchre scoring computer 10 for computation and display by illumination of indicator lamps 14. Indicator lamps 14 have corresponding numerical values indicating the respective values of either points, games, or skunks of one or more players. An on/off switch 24 controls applications of D.C. power to the electronic circuitry.

Figure 2A:
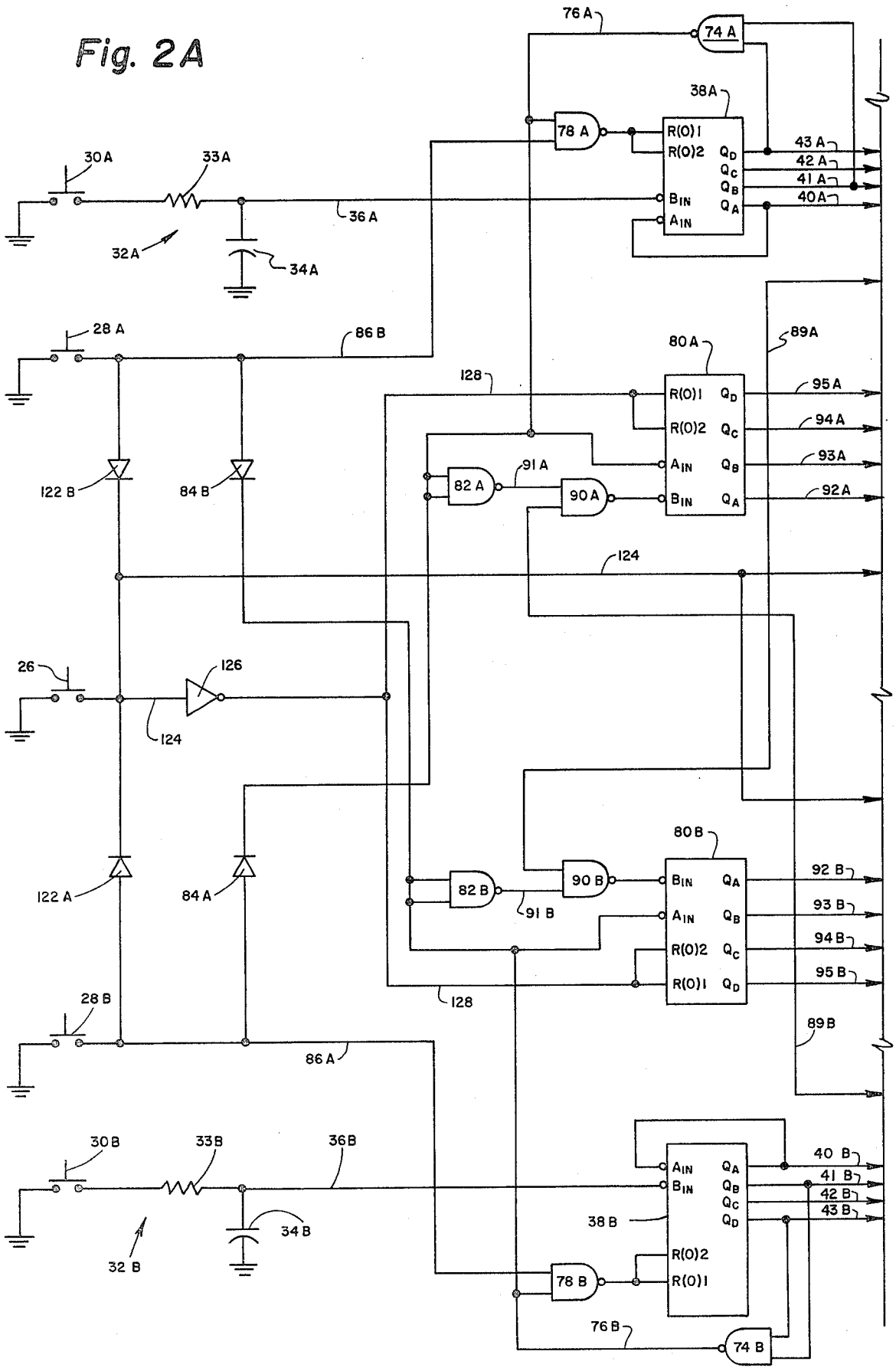
FIGS. 2A and 2B are electrical schematics of an embodiment of the euchre scoring computer showing the logic interconnection thereof.
Figure 2B:
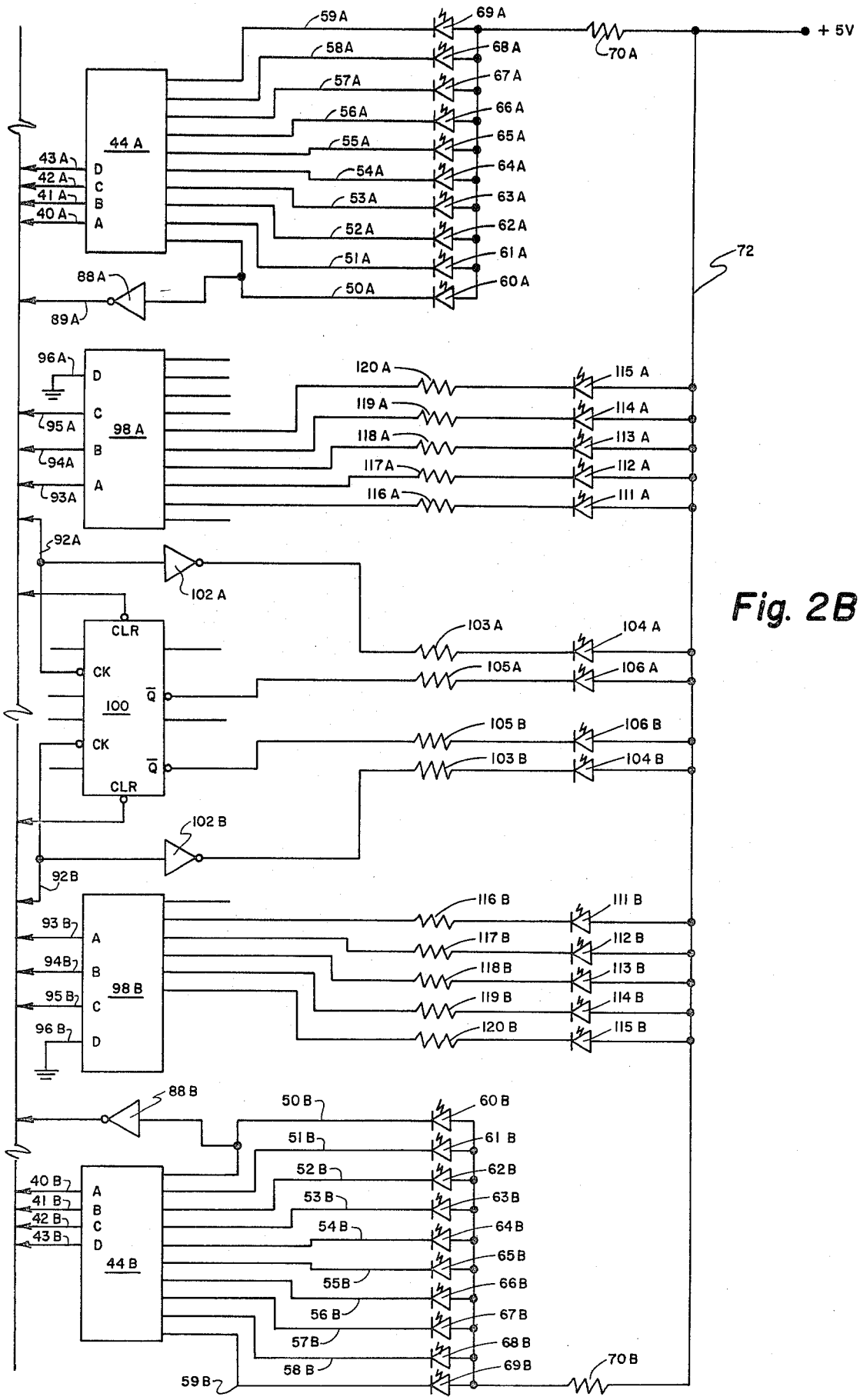

Referring now to FIGS. 2A and 2B the electronic circuitry of the invention is shown. Throughout the ensuing description of the specific embodiment illustrated, with reference to the aforementioned figures, like components and circuitry common to each individual player positions are referred to by like numerical designations followed by either the suffix "A" or "B". A description of one such aspect of this specific embodiment shall suffice for the description of the other and such description will not therefore be duplicated for corresponding portions or functions.

Power is supplied to euchre scoring computer 10 as a positive five volts direct current. For portable operation, a battery power supply may be incorporated within case 18 of euchre scoring computer 10. When an alternating current source is accessible, any of a number of commerically available low voltage direct current skunk line 89B causes a logic zero level to appear on output line 92A. This causes a logic one level to appear at the output of inverter 102A while causing dual flip-flop 100 to change state such that a logic zero level appears at resistor 105A causing the illumination of light emitting diode 106A. A subsequent indication of a logic zero level appearing on tens line 76A coupled with a logic one level appearing on skunk line 89B causes a logic one level to appear on output line 92A thereby illuminating light emitting diode 104A while light emitting diode 106A remains illuminated.

Depressing clear button 28A causes a logic zero level to appear at a second input of NAND gate 78A. This causes a logic one level to appear at the output thereof, which is applied to the R(0)1 and R(0)2 inputs of four bit binary points counter 38A. In this manner, $Q_A$ line 40A, $Q_B$ line 41A, $Q_C$ line 42A and $Q_D$ line 43A are reset to logic zero levels. Similarly, four bit binary points counter 38A may be reset by having a logic zero level appear on clear points line 86B by the appearance of a logic zero level at the output of NAND gate 74B through diode 84B.

Should it be desired to clear four bit binary points counter 38A and 38B, four bit binary games counters 80A and 80B, and both portions of dual flip-flop 100, clear/reset button 26 is depressed thereby placing a logic zero level on reset/clear line 124 to inverter 126. This causes a logic one level to appear on reset line 128 for application to the R(0)1 and R(0)2 inputs of four bit binary games counters 80A and 80B. This causes output lines 92A and 92B, 93A and 93B, 94A and 94B and 95A and 95B to return to a logic zero level. Simultaneously, a logic zero level on reset/clear line 124 is applied through diodes 122A and 122B to clear points lines 86A and 86B respectively. Similarly, a logic zero level on reset/clear line 124 serves to clear both portions of dual flip-flop 100.

In operation, players would operate the euchre scoring computer 10 in conjunction with a card game. Power to euchre scoring computer 10 would be applied through actuation of on/off switch 24 causing the illumination of light emitting diodes 60A and 60B indicating no unit points for either player. As either player scores points in conjunction with the card game, such player would actuate either points button 30A or 30B. Each actuation of points button 30A or 30B causes a corresponding count up through the indicator lamps 14 such that when light emitting diodes 69A or 69B are illuminated a total of nine unit points is indicated for the respective player. If light emitting diode 69A is illuminated, the next actuation of points button 30A causes light emitting diode 111A and 60A to illuminate indicating that the player has, by obtaining 10 unit points, won a game point, or one game. Any player achieving ten unit points before his opponent achieves such a number is awarded a game point. In addition, the awarding of a game point to a given player automatically returns the opponent's unit point indication to zero such that a successive game can be begun. Should a given player achieve a total of ten unit points before his opponent scores any unit points, then a skunk point is awarded the winning player through the illumination of light emitting diode 104A or 104B. A player having one more than one skunk point is indicated by the illumination of light emitting diode 106A or 106B while a third skunk point for a player is indicated by the illumination of both light emitting diodes 104A and 106A or light emitting diodes 104B and 106B.

Should it be desired to clear the indication of unit points for either player, then clear buttons 28A and 28B may be utilized to return the indication of indicator lamps 14 to a condition such that, of light emitting diodes 60A through 69A or 60B through 69B, only light emitting diodes 60A or 60B are illuminated indicating zero unit points for that player. At the termination of a given series of card games, the entire euchre scoring computer 10 may be cleared by depressing clear/reset button 26 thereby extinguishing all ndicator lamps 14 except for light emitting diode 60A and 60B. This thereby gives the players an indication of zero unit points per player with neither player having any game points or skunk points.

Therefore, by the apparatus and method of the invention an improved euchre scoring computer 10 is provided which requires only push button operation and which automatically awards a game to the first player achieving a given number of unit points. Additionally, the euchre scoring computer 10 automatically clears all unit point indicator lamps 14 after any player receives said given number of unit points. Moreover, the apparatus and method of the euchre scoring computer 10 automatically awards the player who obtains said given number of unit points to his opponent's zero number of unit points, a skunk point.

While there have been described above the principles of this invention in connection with specific apparatus, it is to be clearly understood that this description is made only by way of example and not as a limitation to the scope of the invention.

What is claimed is:

1. A euchre scoring computer comprising:

first and second means for inputting unit point information, first and second means for totalling said unit point information from said first and second inputting means respectively, first and second means responsive to said first and second totalling means respectively for generating game point information and zeroing said second and first totalling means respectively, first and second means responsive to said first and second generating means and said second and first totalling means respectively for establishing skunk point information, first and second means for displaying said unit, game and skunk point information, first and second means for resetting said first and second totalling means respectively, and means for clearing said first and second totalling, generating and establishing means.

2. The apparatus of claim 1 wherein said inputting means comprise electrical switches, said resetting means comprise electrical switches, and said clearing means comprise electrical switches.

3. The apparatus of claim 1 further comprising first and second means for contact debouncing electrically interconnecting said first and second inputting means and said first and second totalling means, respectively.

4. The apparatus of claim 3 wherein said first and second contact debouncing means comprise low pass RC filter networks.

5. The apparatus of claim 1 wherein said first and second totalling means comprise binary counters.

6. The apparatus of claim 5 wherein said binary counters are four bit binary counters.

7. The apparatus of claim 1 wherein said first and second generating means comprise NAND gates and binary counters interconnected to the output of said first and second totalling means respectively.

8. The apparatus of claim 1 wherein said first and second establishing means comprise flip-flops.

9. The apparatus of claim 1 wherein said resetting means are electrical switches, said inputting means comprise electrical switches.

10. The apparatus of claim 1 wherein said clearing means comprise electrical switches, and said inputting means comprise electrical switches.

11. A method for computing and displaying euchre scores comprising the steps of:

inputting first and second unit point information to respective first and second totalizers, totalling said first and second unit point information at said respective first and second totalizers, generating first and second game point information at respective first and second generators responsive to said first and second totalizers respectively, zeroing said second and first totalizers in response to said first and second generators respectively, establishing first and second skunk point information at respective first and second establishers responsive to said first and second generators and said second and first totalizers respectively, and displaying said first and second unit, game and skunk point information.

12. The method of claim 11 further comprising the steps of resetting said first and second totalizers, and clearing said first and second totalizers, generators and establishers.

13. The method of claim 12 wherein said step of inputting is carried out by means of electrical switches.

14. The method of claim 13 further comprising the step of filtering said first and second unit point information for input to said respective first and second totallizers.

15. The method of claim 14 wherein said step of filtering is carried out by means of low pass RC filter networks.

16. The method of claim 12 wherein said steps of resetting and clearing are carried out by means of electrical switches.

17. The method of claim 11 wherein said step of totalling is carried out by means of binary counters.

18. The method of claim 11 wherein said step of generating is carried out by means of NAND gates and binary counters interconnected to the output of said first and second totallizers.

19. The method of claim 11 wherein said step of establishing is carried out by means of flip-flops.

20. The method of claim 11 wherein said step of displaying is carried out by means of light emitting diodes.

* * * * *